US005566661A

United States Patent [19]

Zorita

[11] Patent Number: 5,566,661

[45] Date of Patent: Oct. 22, 1996

[54] FUEL ECONOMIZERS, APPLICABLE TO GAS-OIL AND GASOLINE ENGINES AND BURNERS

[76] Inventor: D. Gonzalo G. Zorita, Ronda de Santa María, n° 2, -28880 Meco (Madrid), Spain

[21] Appl. No.: 480,603

[22] Filed: Jun. 8, 1995

[30] Foreign Application Priority Data

Jan. 10, 1995 [ES] Spain ..... 9500053

[51] Int. Cl.[6] ..... F02M 33/00

[52] U.S. Cl. ..... 123/538

[58] Field of Search ..... 123/538, 536, 123/537; 431/1, 2; 210/222, 695

[56] References Cited

U.S. PATENT DOCUMENTS

| | | | |
|---|---|---|---|
| 4,711,271 | 12/1987 | Weisenbarger et al. | 123/538 |
| 5,124,045 | 6/1992 | Janczak et al. | 123/538 |
| 5,129,382 | 7/1992 | Stamps et al. | 123/538 |
| 5,238,558 | 8/1993 | Curtis | 123/538 |
| 5,271,369 | 12/1993 | Melendrez | 123/538 |
| 5,296,141 | 3/1994 | Ellison | 123/538 |
| 5,320,751 | 6/1994 | Burns | 123/538 |
| 5,356,534 | 10/1994 | Zimmerman et al. | 123/538 |
| 5,359,979 | 11/1994 | Anfinson et al. | 123/538 |

*Primary Examiner*—Marguerite McMahon
*Attorney, Agent, or Firm*—Helfgott & Karas, PC.

[57] ABSTRACT

A magnetic housing, that is coupled to a fuel consumption pipe in a gas or gas-oil combustion engine, is disclosed. The magnetic housing comprises a pair of magnets, a magnetic receiver and a magnetic transmitter, for producing magnetic fields on fuel flowing through the coupled pipe to reduce the fuel consumption rate. The housing comprises a main body having a cylindrical shaped bottom portion with a cylindrical recess for supporting an exposed cylindrical magnetic receiver and a top portion having a pair of winged vertical projections, curved at the same degree as the cylindrical bottom portion. Each projection has inner helicoidal threading and each positioned to allow the pipe to rest therebetween on the exposed magnet. The housing also comprises a complementary body having a cylindrical shape with a cylindrical recess at its bottom for supporting an exposed magnetic transmitter. The complementary body has an outer helicoidal threading acceptable into the inner threading of the projections upon rotation to secure the pipe between the exposed magnets of the main and complementary bodies.

3 Claims, 1 Drawing Sheet

FUEL ECONOMIZERS, APPLICABLE TO GAS-OIL AND GASOLINE ENGINES AND BURNERS

DESCRIPTION

The present specification refers to a Utility Model related to a fuel economizer, applicable into gas-oil and gasoline engines, the evident purpose of which is to attain a substantial consumption saving or reduction, and, at the same time, to avoid or at least to reduce contaminant fumes, without any detrimental effect on the performance of those engines utilizing this economizer, independently on the fact that same are fed by gasoline or gas-oil, allowing them also to be incorporated, with identical results, into fuel-oil burners applied to heating boilers or similar.

FIELD OF THE INVENTION

This invention applies to the industry devoted to the manufacture of implements, economizing devices and apparatuses of fuel, applied into engines and burners.

SUMMARY OF THE INVENTION

The fuel economizer, applicable into gas-oil and gasoline engines and burners as proposed by the invention constitutes per se an evident novelty on the industrial arena into which it incorporates, since starting from same, it is possible to have a device capable of substantially reducing the costs of engines fed by way of gasoline or gas-oil, including also fuel-oil burners incorporated into heating boilers or similar, by obtaining, at the same time, a reduction of contaminant fumes, and being configured so that its installation does not imply any type of marginal implement on the original installation in a vehicle.

In a more definite way, the fuel economizer, applicable into gas-oil and gasoline engines and burners of the invention is constituted starting from a body adopting a general configuration of a cylinder made of a metallic material, such as brass or similar, exhibiting, at its low part, a fully cylindrical area having a central drilling to receive a material to be used as a magnetic receiver, with two winged projections emerging from its sides which allow it to be inserted within a conductor pipe of fuel, the inside portion being configured as a curved shape, and being fitted with an inner threading in order to make easy to insert a second body formed as a practically solid cylinder having an external helicoidal threading coincidental with the threading existing at the inner portion of the winged projections emerging from the base, said cylindrical body having a circular plan protuberance at the upper portion, having a transverse split to allow an implement to be inserted in order to attain an appropiate fitting of this body inside the carrier, until obtaining it to be attached to the pipe surface carrying the fuel to be handled.

It should be pointed out that inside the above-mentioned cylindrical body, there is a hollow area having a magnetic transmitter incorporated, the performance of which, in collaboration with the above-mentioned receiver, act on the fuel passing inside the pipe on which the economizer is installed.

On the lines of the above stated, it is clearly seen that the installation of the economizer of the invention does not require any marginal material to be used, and its fitting is practically carried out in a manual way,with the only and sole application of a tightening element or screwdriver on the area of the transverse split located on the part carrying the magnetic transmitter.

BRIEF DESCRIPTION OF THE DRAWINGS

In order to complement this description and aid to a better understanding of the features of the invention, the accompanying drawings, which are a part of this specification, show in an illustrative but non limitative sense, the following.

DETAILED DESCRIPTION OF THE PREFERRED EMBODIMENT

Figure 1:
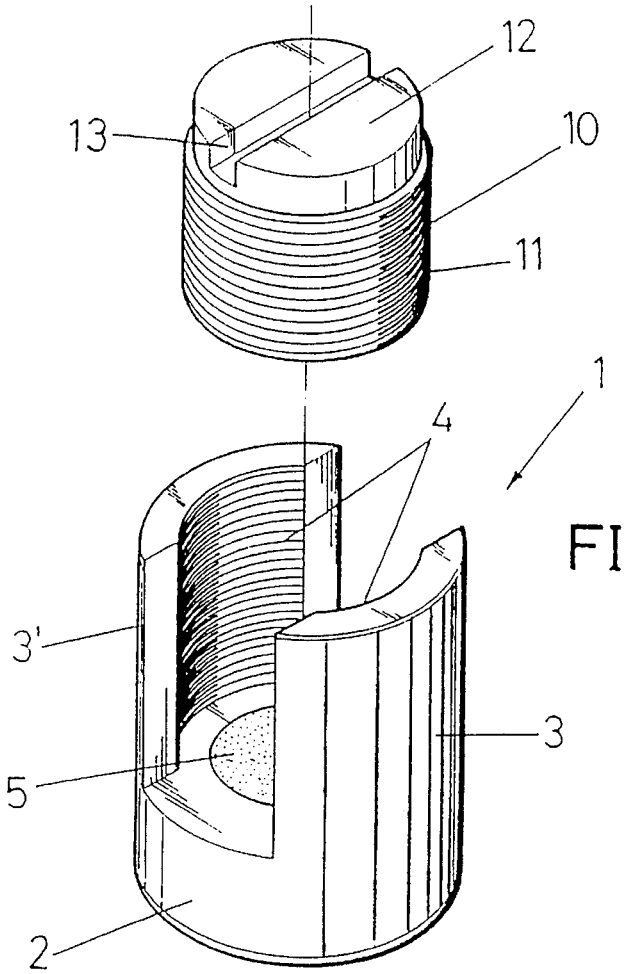
FIG. 1 shows a perspective view of the object of the invention related to a fuel economizer, applicable into gas-oil and gasoline engines and burners.
Figure 2:
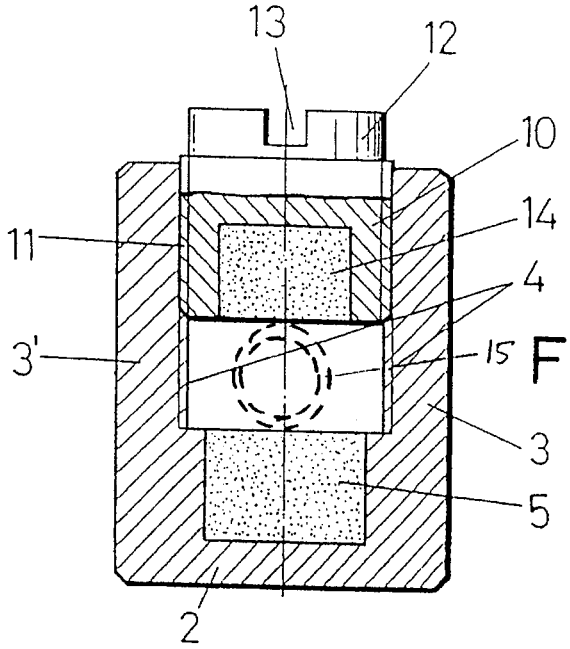
FIG. 2 shows a side elevational view, in section, of the object of the invention, this figure showing also the coupling of the two parts composing it.

From these figures, it can be seen how the fuel economizer, applicable into gas-oil and gasoline engines and burners is configured starting from two parts (1) and (10) having as a common denominator the fact that they are practically constituted as two cylinders made of a metallic material, such as brass, bronze, etc.

The main part (1), acting as a nucleus or base (1), presents a lower portion (2), fully cylindrical from which two vertical projections (3) and (3') emerge at the upper part, these projections being outwardly curved in a similar way to the body from which they emerge, having an inner helicoidal threading, being separated from one other by a wide opening, destined to receive a fuel conducting pipe (15) which will receive the magnetic effects of a magnetic receiver nucleus (5) existing in the central area (2).

The complementary part (10), acting as a plug, is configured as a solid cylinder having an outer helicoidal threading (11), coincidental with the helicoidal threading (4) provided on the vertical winged portions (3) and (3') of the part (1), the part (10) having, at its upper portion, a circular plan protuberance (12) fitted with a central split (13) to facilitate the tightening of the complementary part (10) within the main part (1) in order to fit the complementary part (10) on the pipe (15) when this pipe (15) is installed inside the winged vertical projections (3) and (3').

Within the complementary part (10), a magnetic transmitter (14) has been provided, which obviously acts in a direct collaboration with the—magnetic receiver (5), the influence of this embodiment receiving the fuel passing through the pipe in which the economizer has been located.

It should be pointed out that this invention, apart from allowing it to be incorporated into fuel-oil burners in heating boilers or similar, so obtaining that, with the collaboration of the assembly formed by the magnetic transmitter and the magnetic receiver, the fuel mixture can be treated by induction before it enters the explosion chamber, so obtaining also that the mixture burning will be practically perfect, and the emission of carbon monoxide particles and other contaminants will be removed in a high percent.

Apart from the invention, and not seeking any sort of exclusive, it has been checked that the fuel saving is on the order of between 10% and 15% when this economizer is installed in the fuel pipe, and it has been also checked that the deposition of scale in the explosion chamber and valve seats is reduced by 75%.

It has been also confirmed that an engine heats less and produces less vibrations, both the catalyst and the exhaust pipe lasting practically three times more than when the economizer is not installed.

As a determinant detail, it has been proved that, starting from the very moment the economizer has been fitted, the number of revolutions with the same neutral increases, and when it is incorporated into gas-oil or fuel-oil heating boilers, the noise is appreciably very reduced.

It is not considered necessary to extend more of this description for an expert in the art to understand the scope of the invention and the advantages derived from it.

The materials, shape, size and arrangement of the elements are open to variation, provided that it does not imply any alteration to the essence of the invention.

The terms under which this specification has been described should be always taken in an ample and non limitative sense.

I claim:

1. A magnetic housing for producing magnetic fields on a fuel conduction pipe having fuel flowing therethrough for reducing the fuel consumption rate of a combustion engine, said housing comprising:

a main body comprising a bottom portion having a cylindrical shape with a cylindrical recess for supporting an exposed cylindrical magnetic receiver, and a top portion having a pair of winged vertical projections, curved at the same degree as the cylindrical bottom portion, each of said projections having an inner helicoidal threading and each positioned apart from one another to allow said pipe to rest on the exposed magnet therethrough; and a complementary body having a cylindrical shape with a cylindrical recess at the bottom thereof for supporting an exposed cylindrical magnetic transmitter, said complementary body further having an outer helicoidal threading acceptable into said inner helicoidal threading of said projections upon rotating said complementary body to secure said pipe between the exposed magnets of the main and complementary bodies.

2. The housing according to claim 1, wherein said main and complementary bodies comprise a metallic material.

3. The housing according the claim 1, wherein said complementary body further comprises a circular plan protuberance having a central split, coupled above said outer helicoidal threading, for assisting in said rotating of said complementary body.

* * * * *